US008911575B1

(12) United States Patent
Di Stasio et al.

(10) Patent No.: US 8,911,575 B1
(45) Date of Patent: Dec. 16, 2014

(54) MOLDABLE EXPLOSIVES FORMULATED WITH CHLORINATED WAXES AND OILS

(75) Inventors: Anthony R. Di Stasio, New York, NY (US); Sanjeev K. Singh, Dover, NJ (US); Daniel Zaloga, Allamuchy, NJ (US); Rajen Patel, Iselin, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/246,333

(22) Filed: Sep. 27, 2011

(51) Int. Cl.

| | |
|---|---|
| ***C06B 25/00*** | (2006.01) |
| ***C06B 25/34*** | (2006.01) |
| ***D03D 23/00*** | (2006.01) |
| ***D03D 43/00*** | (2006.01) |

(52) U.S. Cl.
USPC ..... 149/92; 149/88; 149/108.8; 149/109.4; 149/109.6

(58) Field of Classification Search
USPC ..... 149/92, 88, 108.8, 109.4, 109.6
See application file for complete search history.

(56) References Cited

U.S. PATENT DOCUMENTS

| | | | | |
|---|---|---|---|---|
| 4,469,623 | A * | 9/1984 | Danielson et al. | 252/408.1 |
| 5,413,812 | A * | 5/1995 | Simpson et al. | 427/212 |
| 5,445,690 | A * | 8/1995 | Wulfman | 149/109.6 |
| 6,668,727 | B1 * | 12/2003 | Kim et al. | 102/482 |
| 7,955,452 | B1 * | 6/2011 | Singh et al. | 149/3 |
| 2005/0235858 | A1 * | 10/2005 | Reynolds et al. | 102/202.14 |

* cited by examiner

*Primary Examiner* — James McDonough
(74) *Attorney, Agent, or Firm* — Henry S. Goldfine

(57) ABSTRACT

Moldable explosives containing chlorinated and/or fluorinated oils and waxes are described which exhibit significant energetic characteristics while at the same time possessing desirable IM character. Such moldable explosives are potential replacements for the C4 compositions known and used in the art.

10 Claims, No Drawings

MOLDABLE EXPLOSIVES FORMULATED WITH CHLORINATED WAXES AND OILS

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of energetic materials. More particularly, it pertains to moldable explosives containing chlorinated waxes and oils.

BACKGROUND OF THE DISCLOSURE

Moldable explosives have widespread applicability in military and industrial applications. Concurrent with this widespread use are efforts to make such moldable explosives less sensitive to unintended detonation—a characteristic which is generally known in the art as insensitive munitions (IM).

Accordingly, moldable explosive compositions which exhibit this IM characteristic without significant loss of energetic output would represent an advance in the art.

SUMMARY OF THE DISCLOSURE

An advance in the art is made according to an aspect of the present disclosure directed to moldable explosives containing chlorinated waxes and/or oils. Advantageously, moldable explosives formulated according to aspects of the present disclosure exhibit a satisfactory IM characteristic while—at the same time—not appreciably losing desired energetic effects.

Viewed from a first aspect, the present disclosure is directed to a moldable explosive composition comprising: 60-75 wt % of an explosive selected from the group consisting of: RDX, TNT, TATB and CL20; 25-35 wt % halogenated oil; and 0-5 wt % halogenated wax.

Viewed from another aspect, the present disclosure is directed a method for making a moldable explosive composition comprising the steps of: combining a quantity of an explosive selected from the group consisting of: RDX, TNT, TATB and CL20, along with a quantity of halogenated oil along with a quantity of a halogenated wax such that the overall mixture includes 60-75 wt % of the explosive, 25-35 wt % of the halogenated oil and 0-5 wt % of the halogenated wax; and mixing the combined materials until a substantially homogeneous, moldable solid is produced.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereat are intended to encompass both structural and functional equivalents thereof. Additionally, it is intended that such equivalents include both currently-known equivalents as well as equivalents developed in the future, i.e., any elements developed that perform the same function, regardless of structure.

By way of some additional background, it is noted that composition C4 explosive—or C4 as it is commonly known in the art is a widely used plastic explosive which comprises approximately 91% by mass RDX (cyclonite or cyclotrimethylene trinitramine), 5.3% by mass plasticizer (diethylhexyl or dioctyl sebacate) and 2.1% by mass binder—usually polyisobutylene.

C4 is typically manufactured by combining the noted ingredients with binder dissolved in a solvent. The solvent is then flashed off and the mixture dried and filtered. The final material is an off-white solid having a texture similar to modeling clay.

Due in part to its unique and difficult to replicate characteristics, C4 has been a military and industrial staple for 50+ years. It advantageously maintains a high level of moldability and energetic performance. It may be forced into cracks or voids easily by hand manipulation—giving it a distinct advantage over other—more rigid explosives. Despite its physical flexibility and energetic power, it exhibits favorable insensitive munitions (IM) character. Given these difficult to replicate characteristics—replacements for C4 while extremely desirable have not been forthcoming.

Such an advance is made in the art according to an aspect of the present disclosure directed to moldable explosives having significant IM characteristics. Such explosives are advantageously produced—according to the present disclosure—through the use of chlorinated waxes and/or oils in their formulation and compounding. Advantageously, such compositions formulated with chlorinated waxes and oils benefit from the relative low cost of such waxes and oils, they bind well to RDX—unlike the binders used in C4, and they are hydrophobic, chemically inert and exhibit a very low vapor pressure.

EXAMPLES

A series of formulations were developed to evaluate the use of chlorinated binders in moldable explosives. More particularly, to a quantity of 60-75% by weight RDX (Class V—4 micron) was added 35-25% by weight chlorinated oil and 0-5% chlorinated wax. The mixture was combined and mixed using a common B&P mixing system. As may be readily apparent to those skilled in the art, such a 1 step process offers distinct advantages over the conventional, 3-step C4 manufacturing process.

The resulting compositions (moldable explosives) exhibit Chapman and Jouguet (CJ) pressures nearly identical to contemporary C4 while still maintaining 90% of the performance of the C4. And since they exhibit a more favorable consistency permitting hand packing, more effective hand-packed shaped charges are possible with the explosives according to the present disclosure than with the C4.

Variations to the above to evaluate IM characteristic were performed by reducing the amount of RDX employed (up to 20% less). As may be appreciated, energetic performance was still satisfactory while exhibiting a significant drop in sensitivity. Accordingly, a wide array of C4 replacements may be formulated according to the present disclosure wherein chlorinated waxes and oils are mixed with RDX to produce the moldable explosive.

At this point we note that given their desirable moldable characteristics, explosives formulated according to the present disclosure may be extruded after mixing into any of a variety of shapes possible with contemporary extruding method(s). More particularly, ropes of varying dimensions may be produced as well as ropes exhibiting particular cross-sectional shapes.

As may be further appreciated, moldable explosives according to the present disclosure are not limited to RDX formulations and sizes. More particularly, other explosives—including but not limited to—such as Trinitrotoluene—TNT, cyclotrimethylenetrinitramine—RMX, triaminotrinitrobenzene—TATB and 2,4,6,8,10,12-hexanitro-2,4,6,8,10,12-hexaazaisowurtzitane—CL20 are all suitable for use in formulations according to the preset disclosure.

In addition to these noted explosives, any of a number of known taggants and/or other chemical markers may be included in the formulation. Such tagants are added to the explosive formulation so that a manufacture and/or batch information may be obtained post-detonation. Still further, as an alternative to the chlorinated waxes and/or oils described, other halogenated oils and/or waxes—i.e., fluorinated ones—may be employed as well. Still further, chlorinated and/or fluorinated rubbers or elastomers may be mixed with the energetic explosive, as they are chemically similar to the currently used binder ingredients, and may promote elasticity.

At this point, while we have discussed and described exemplary embodiments generally directed to halogen containing waxes and oils added to explosive compositions to produce an overall, moldable explosive composition exhibiting significant IM characteristics. Further variations to the compositions described are anticipated to be within the scope of the present disclosure and as such—the present disclosure should only be limited by the scope of the claims that follow.

The invention claimed is:

1. A hand moldable explosive composition comprising:

60-75 wt % of an explosive selected from the group consisting of: RDX, TNT, TATB and CL20;

25-35 wt % halogenated oil;

0-5 wt % halogenated wax; and wherein said hand moldable explosive exhibits Chapman and Jouguet pressures equivalent to C4.

2. The moldable explosive composition of claim 1 further comprising a taggant.

3. The moldable explosive composition of claim 1 wherein said halogenated oil is a chlorinated one.

4. The moldable explosive composition of claim 1 wherein said halogenated oil is a fluorinated one.

5. The moldable explosive composition of claim 1 wherein said halogenated wax is a chlorinated one.

6. The moldable explosive composition of claim 1 wherein said halogenated wax is a fluorinated one.

7. The moldable explosive composition of claim 1 further comprising a quantity of halogenated rubber.

8. The moldable explosive composition of claim 1 further comprising a quantity of halogenated elastomer.

9. A method for making a moldable explosive composition comprising the steps of:

combining a quantity of an explosive selected from the group consisting of: RDX, TNT, TATB and CL20, along with a quantity of halogenated oil along with a quantity of a halogenated wax such that the overall mixture includes 60-75 wt % of the explosive, 25-35 wt % of the halogenated oil and 0-5 wt % of the halogenated wax; and mixing the combined materials until a substantially homogeneous, moldable solid is produced.

10. The method of claim 9 further comprising the step of adding a taggant to the combined materials.

* * * * *